US006422394B1

(12) United States Patent
Page

(10) Patent No.: US 6,422,394 B1
(45) Date of Patent: Jul. 23, 2002

(54) CONTINUOUS CLEANING SYSTEM FOR SCREENING MACHINES

(76) Inventor: William Harold Page, 9366 State Rte. 117, Huntsville, OH (US) 43224

( * ) Notice: Subject to any disclaimer, the term of this patent is extended or adjusted under 35 U.S.C. 154(b) by 0 days.

(21) Appl. No.: 09/792,916

(22) Filed: Feb. 26, 2001

(51) Int. Cl.[7] ..... B07B 1/54
(52) U.S. Cl. ..... 209/383; 209/381
(58) Field of Search ..... 209/379, 381, 209/382, 383

(56) References Cited

U.S. PATENT DOCUMENTS

| | | | | | |
|---|---|---|---|---|---|
| 266,985 | A | * | 11/1882 | Gathmann | 209/363 |
| 680,466 | A | * | 8/1901 | Sherk | 209/383 |
| 726,319 | A | * | 4/1903 | Mann | 209/382 |
| 890,657 | A | * | 6/1908 | Johnston et al. | 209/383 |
| 2,617,533 | A | * | 11/1952 | Linhardt | 209/383 |
| 3,087,617 | A | * | 4/1963 | Forsberg | 209/382 |
| 4,033,865 | A | | 7/1977 | Derrick | |
| 4,121,779 | A | * | 10/1978 | Mills et al. | 209/383 |
| 4,288,320 | A | | 9/1981 | Wilson | |
| 5,051,171 | A | | 9/1991 | Hukki | |
| 5,266,161 | A | * | 11/1993 | Kroeker | 209/381 |

FOREIGN PATENT DOCUMENTS

| | | | | |
|---|---|---|---|---|
| DE | 975328 | * | 10/1961 | 209/382 |
| DE | 975329 | * | 10/1961 | 209/383 |

OTHER PUBLICATIONS

Iowa Manufacturing Company Catalog pp. 6,18, and 13 (extent of information known) date unavailable.

* cited by examiner

*Primary Examiner*—Donald P. Walsh
*Assistant Examiner*—Daniel K Schlak
(74) *Attorney, Agent, or Firm*—Thomas E. O'Connor, Jr.; Courtney J. Miller

(57) ABSTRACT

A continuous cleaning system to prevent clogging of screens in screening machines used to sort materials such as aggregates, such system comprising positioning a cleaning device such as a chain in line with the length of and on top of, a screen to be cleaned, and then using a motor assembly to rotate said cleaning device thereby moving it back and forth across the top of said screen, so that substantially the entire area of the top of said screen comes in contact with said rotating cleaning device, which taps or otherwise contacts the surface of said screen as it moves back and forth across the top of a screen deck, thereby dislodging any dust or other material that might otherwise clog or block the openings in said screen. In a preferred embodiment, a motor rotates the cleaning device which has the effect of driving it back and forth along a tight cable on which said pulley travels. The speed, power, and direction of the motor is subject to controls which may be easily set by an operator.

5 Claims, 3 Drawing Sheets

CONTINUOUS CLEANING SYSTEM FOR SCREENING MACHINES

The present application pertains to an invention that was not performed under any federally sponsored research and development.

TECHNICAL FIELD OF THE INVENTION

This invention relates generally to systems that sort aggregates of various materials by utilizing one more vibrating screens, and specifically to a cleaning device useful for preventing obstructions and blockages of such vibrating screens while said sorting system is in operation.

BACKGROUND OF THE INVENTION

A major problem with systems that sort aggregates of various materials by employing one more vibrating screens is that loose particles, some with moisture, separate from the material being sorted and clog the screen openings, thereby effectively thwarting the screening capability. Previously known de-clogging and cleaning devices and systems used to prevent clogging, or to unclog screens, have proven ineffective or impractical because they required too much labor to install or maintain, and/or experienced frequent breakdowns.

Disclosed in the prior art are systems that utilize a variety of approaches to cleaning or unclogging screens. Such systems include (i) springs that rap against the underside of the screen deck to loosen material, (ii) two screen cloths positioned so that the longitudinal wires of one screen are held securely against the transverse wires of a second screen to prevent spheroidal particles from clogging the upper screen, (iii) a plate and opposing flange system with the flanges spaced to fit in interference with the frame, and (iv) rubber cylinders, trapped or caged in the space between screens of various size openings, which rubber cylinders, without being attached to any motor driving them, bounce against the small clear opening wire, dislodging and cleaning the screen wire openings. However, none of this prior art discloses or suggests the method and system of the present invention.

SUMMARY OF THE INVENTION

The present invention provides a continuous cleaning of the screen deck surfaces of a screening machine, without being dependent on the material used to make the screen. Worker safety is enhanced as use of the current invention avoids the need for workers to climb to the screen of a cleaning machine manually to dislodge clogging material.

The invention prevents obstructions and blockages of screening systems such as those used to sort aggregates, by continuously cleaning the screens, and comprises: a length of cleaning device positioned across the length of and on top of said screen being cleaned; a motorized system to rotate said cleaning device and thereby to move said cleaning device across the width of said screen, said motorized system comprising (a) a motor, having a rotating shaft, connected to said cleaning device which rotates such device, (b) a travel system on which said motor travels ("travel system") back and forth across the width of the screen deck being cleaned, and (c) controls and switches to regulate the power and direction of the motor. Said travel system may comprise (i) posts at the entry end of said screen (the end where material to be sorted enters upon said screen) to support a cable positioned horizontally across and in parallel relationship with the width of, and above, the screen to be cleaned, the top of said posts being connected to a rigid structural member between said posts; (ii) said cable so positioned; (iii) a pulley attached by a bracket to said motor and positioned to roll back and forth along said cable; (iv) a protective cover over the portion of said cleaning device attached to said motor and extending from approximately the point of such attachment to approximately the point just before said cleaning device comes in contact with said screen, and (v) controllers to regulate the power, speed, and direction of said motor and so that the rotation of the shaft of the motor rotates the cleaning device and moves it across the top surface of a screen, said rotation having the effect of driving the assembly of the motor, bracket, pulley and cleaning device back and forth over the travel system. As said cleaning device rotates and taps the surface of the screen, said surface is thereby continuously cleaned.

Further advantages of the present invention will become apparent to those of ordinary skill in the art upon reading and understanding the following detailed description of the preferred embodiments

DETAILED DESCRIPTION OF THE INVENTION

Figure 1:
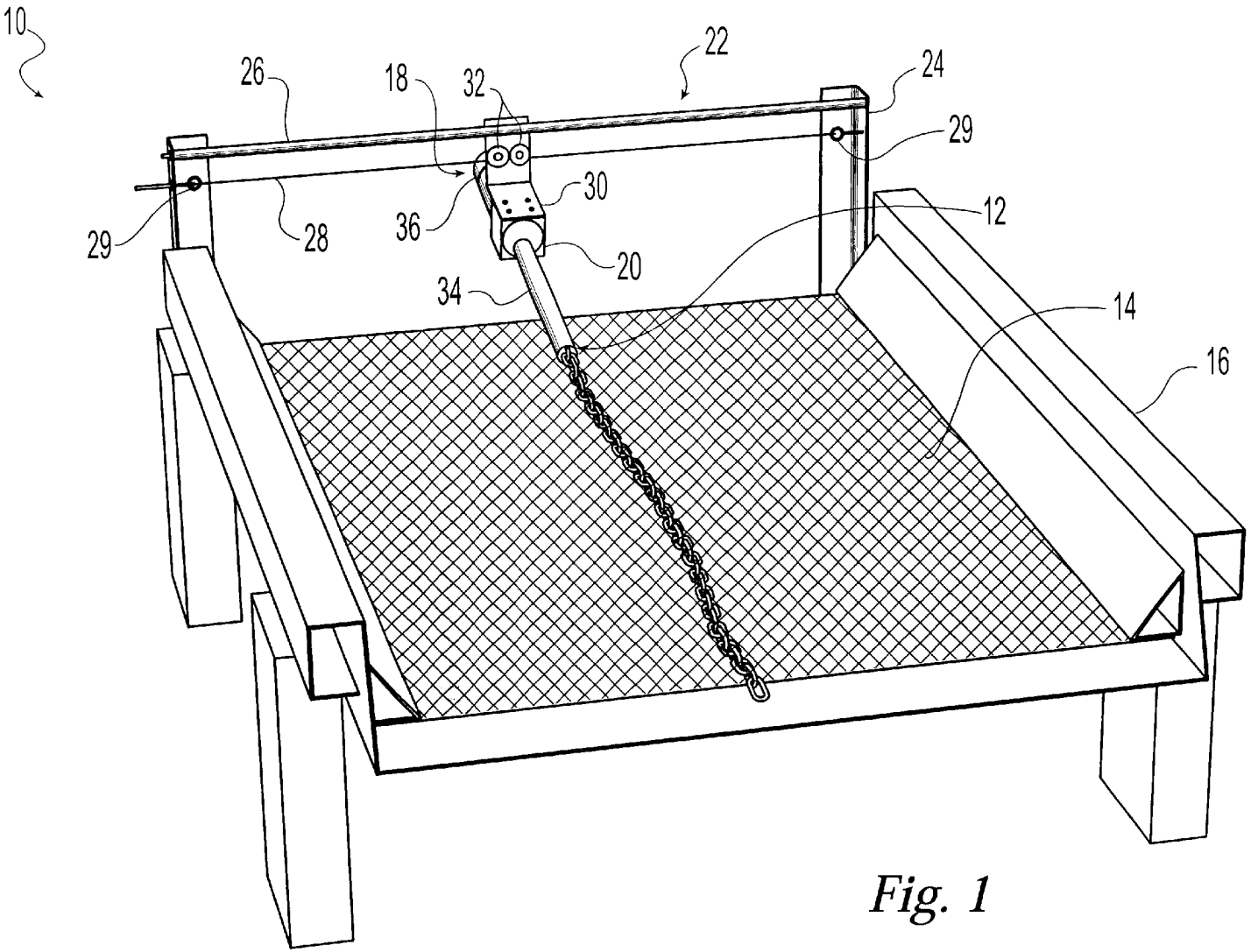
FIG. 1 is a perspective view of a screen with the operative portion of the cleaning device traversing the length of the screen being cleaned. Also depicted is the cleaning device from the point it is attached to the motor to the point it first contacts the screen to be cleaned, and the protective cover enclosing said cleaning device between such two points.

As best shown by FIG. 1, and according to a preferred embodiment of the present invention, cleaning system 10 provides a cleaning device 12 and a motorized system 18 for moving cleaning device 12 back and forth across the width of screen deck 16. Cleaning device 12 further comprises a length of chain or urethane cable positioned on top of and along the length of screen deck 16. As stated, motorized system 18, which further comprises motor 20 and travel system 22, moves cleaning device 12 back and forth across the width of screen deck 16, thereby subjecting the entire surface of screen deck 16 to a tapping action created by cleaning device 12. This tapping action loosens accumulated material that may have become lodged or encrusted on the wires forming screen 14. If not loosened, this accumulated material tends to block the openings formed by the wires of screen 14, thereby inhibiting the screening or sorting capability of the screening or sorting device.

Figure 2:
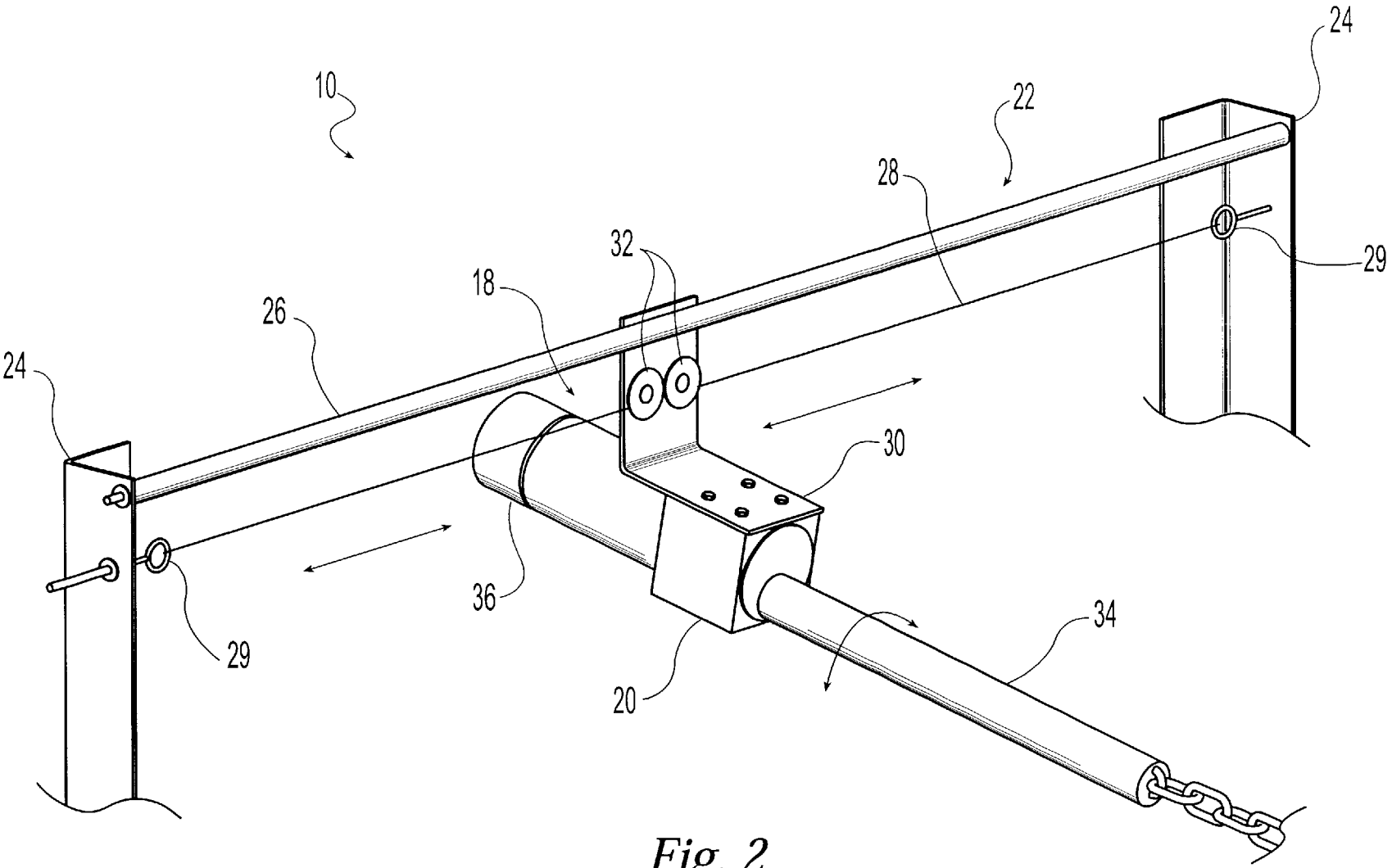
FIG. 2 is a perspective view of the end posts, structural member between the tops of said posts, motor, bracket, pulleys, and support cable used to rotate and thereby move the cleaning device back and forth across the surface of the screen to be cleaned.

As best illustrated by FIG. 2, motor 20 is mounted on travel system 22, which further comprises posts 24, structural member 26, support cable 28, bracket 30, and pulley(s) 32. Structural member 26 is attached to posts 24 and is mounted above and parallel to the entry end of screen deck 16. Support cable 28 is also attached to posts 24 and is mounted below and parallel to structural member 26. Bracket 30 is attached to motor 20 and pulley or pulleys 32 are attached to bracket 30. When motorized system 18 is installed in cleaning system 10, pulleys 32 rest against support cable 28 and bracket 30 passes behind and rests against structural member 26.

When in operation, cleaning device 12 is partially in contact with the top surface of screen 14 and is rotated continually by motor 20. The rotation of cleaning device 12 by motor 20, and the contact of cleaning device 12 with the surface of screen 14, provides the energy needed for travel system 22 to move the motor and cleaning device along the length of support cable 28. When motor 20 reaches one of the posts 24, the direction of motor 20 is reversed and the motor and cleaning device move back across screen 14 toward the opposite post 24. The entire surface of screen deck 16 is continuously cleaned by the tapping action of cleaning device 12 as it moves back and forth across the top of screen deck 16.

Cleaning system 10 may be assembled from conventional, commercially available parts. For example, in a preferred embodiment, cleaning device 12 is a Campbell ⅜ inch proof coil chain (stock #014–0623). In alternate embodiments, the diameter of this chain is increased to assist with or enhance the movement of the motor and cleaning device across the screen deck. Optimal chain diameter is determined by the type of material being screened and by any obstacles that may be present on the screen surface.

In one embodiment, a protective cover 34 is a hose that surrounds the portion of the cleaning device from the point where it attaches to motor 20 to the point at which it makes contact with the screen to be cleaned. Preferably, this hose is ⅛ inch (0.32 cm) greater in diameter than cleaning device it surrounds. Where a ⅔ inch (1.7 cm) chain is used as the cleaning device, a 1⅜ inch (3.5 cm) inside diameter hose made of soft rubber with cloth-ply to add support can be used as protective cover 34. Ideally, hose 34 does not include metal components or supports that would damage the surface of the screen. The overall length of support hose varies with the position of the motor, but is typically about 2' to 3' (0.61 to 0.91 cm).

In a preferred embodiment, motor 20 is a commercially available ⅛ horsepower, 90-volt DC, Baldor Motor (No. GPP12543). This 125-RPM motor has 58 inch pounds of torque output and an integrated 20 to 1 gearbox. This motor provides the operator of cleaning system 10 with adequate power to rotate and drive the cleaning device across the screen deck, and permits the operator to adjust the speed of the motor up to 125 RPM. Preferably, a conventional pulley, like those found on mower decks, is mounted on bracket 30 attached to motor 20. Controller 36 that drives motor 20 is, preferably, a 1½ horsepower Baldor DC controller. This controller provides the operator of cleaning system 10 with flexible control over the speed and power being sent to motor 20.

As shown in FIGS. 1 and 2, vertical end posts 24 are positioned at the entry end of a screening machine, each post 24 being slightly outside of each of the two outside edges of such entry end. Preferably, support cable 28, which is mounted between end posts 24, is high quality stainless steel, such as aviation cable, 3⁄16 inch (0.48 cm) in diameter and cut about 12 inches (30.5 cm) wider than the screen deck and tightly strung between the end posts 24. Preferably, support cable 28 is held and tightened at each end by ⅜ inch (0.95 cm) eye bolts 29, and is secured to said eye bolts using two 3⁄16 inch (0.50 cm) oral sleeve swages. Preferably, links between the support cable and motor are provided so that an easy disconnect can be made to assist in the movement of the device.

Figure 3:
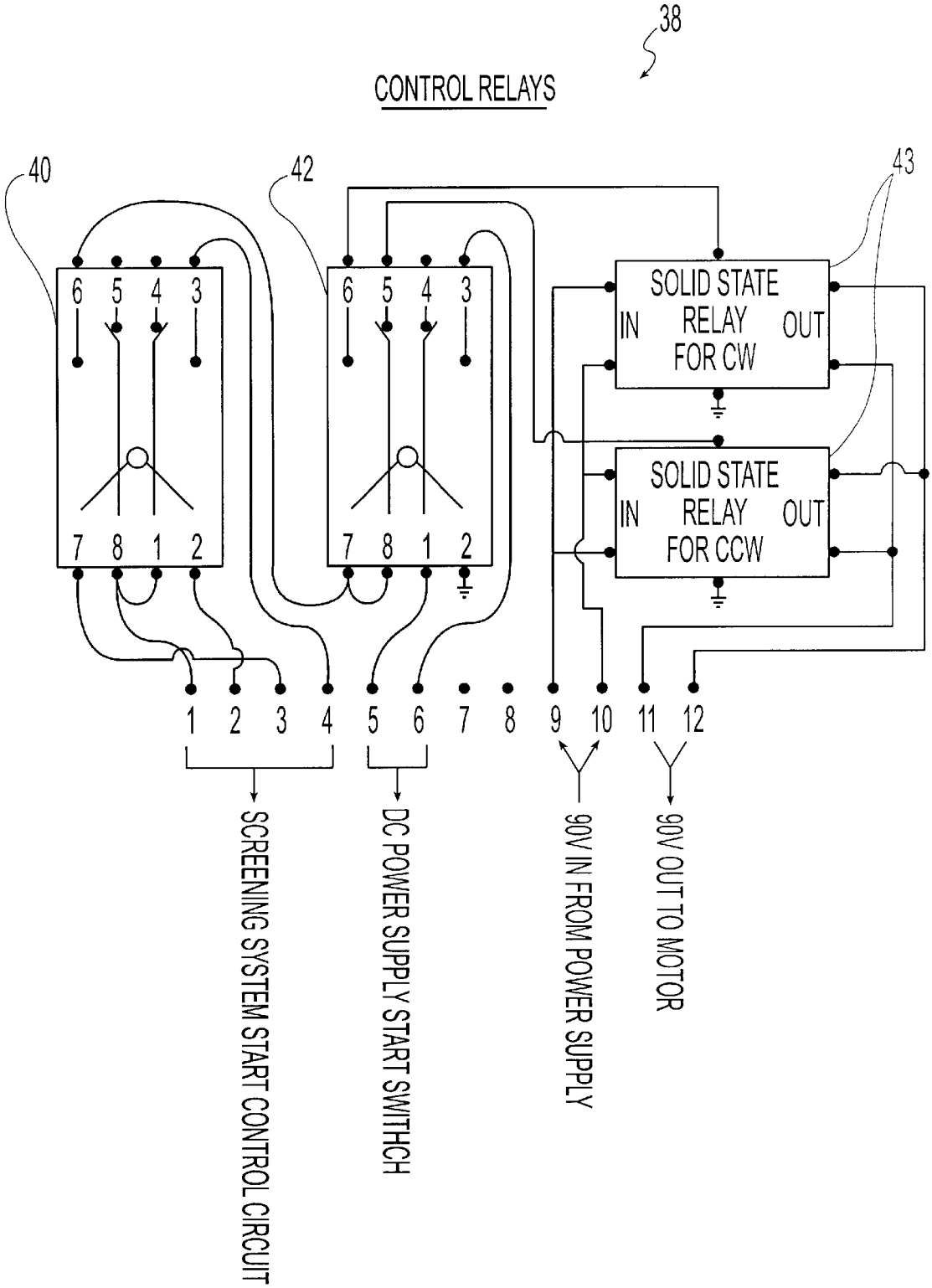
FIG. 3 is a schematic of the connections of the control relays for the preferred embodiment.

As shown in FIG. 3, in a preferred embodiment of this invention, control system 38 controls the operation of cleaning system 10 and uses three relays to perform the system's basic functions. First relay 40 is a power relay that is connected to the start control circuit for the screening machine or system; thus, first power relay 40 provides automatic starting capability to cleaning system 10. Second relay 42 is a "repeat cycle relay" which changes the direction of the motor from forward to reverse by reversing the DC polarity. Second relay 42 also includes an adjustment feature for controlling the time of travel of cleaning device 10 across the screen. Third relay 44 is driven by second relay 42 and handles switching output to the motor. FIG. 3 illustrates the connectivity of control system 38.

In an alternate embodiment of this invention, motor 20 may be moved from side to side with other linkage means to moveably attach the motor to a cable or track along which the motor assembly moves and to the cleaning device, and with the use of any of several conventional means obvious to one of ordinary skill in the art. For example, the motor could be mounted on one or more wheels, positioned into a track which would move in response to the rotation of the cleaning device, which rotation effectively moves the motor assembly in the direction of the rotation. When a chain is used as a cleaning device, the chain could also have sleeves of urethane on it to extend its life span. Alternatively, a urethane cleaning device, or said urethane sleeves, can have an irregular outer surface so that for example its cross-section would have a "star-of-david" or a corrugated profile or cross-section, or any other profile or cross-section to enhance the dislodging effect of the tapping or other contact between the top of a screen and the cleaning device as it moves across the surface of a screen. The protective support cover is not needed if the cleaning device used "ball up" or "knots" when rotated by the motor, as may occur when a chain is used as the cleaning device.

While the above description contains many specificities, these should not be construed as limitations on the scope of the invention, but rather as exemplification of preferred embodiments. Numerous other variations of the present invention are possible, and it is not intended herein to mention all of the possible equivalent forms or ramifications of this invention.

I claim:

1. A cleaning system to prevent obstructions and blockages of one or more screens of screening machines used to sort aggregates, each such screen having a length, a width, a top side and a bottom side, and an entry end and exit end, by continuously cleaning the top side of each screen, comprising:

a length of cleaning device positioned along the length of and on top of said screen being cleaned;

a motorized system connected to said cleaning device to rotate and move such device across said screen, said motorized system comprising:

a motor having a rotating shaft to which said cleaning device is attached;

a travel system on which said motor travels back and forth across the width of the screen being cleaned at the feed end of the screening machine; and controls and switches to regulate the power and direction of said motor, so that the rotation of the shaft of the motor rotates the cleaning device, said rotation having the effect of moving the assembly of the motor and cleaning device back and forth so that as said cleaning device rotates and taps the surface of the screen, said surface is thereby continuously cleaned.

2. A cleaning system as in claim 1 wherein said travel system comprises:

posts at the entry end of said screen to support a tightly strung cable positioned horizontally across and in parallel relationship with the width of, and above, the screen to be cleaned; and a pulley attached by a bracket to said motor and positioned to roll back and forth along said cable.

3. A cleaning system as in claim 1 further comprising:

a protective support cover over the portion of said cleaning device attached to said motor and extending from approximately the point of such attachment to approximately the point just before said cleaning device comes in contact with said screen; and controls to regulate the power, speed, and direction of said motor.

4. A cleaning system as in claim 1 wherein said cleaning device comprises a chain having one or more urethane sections covering the portion of said chain which comes into contact with said screen.

5. A cleaning system as in claim 1 wherein the exterior of said cleaning device comprises an irregular shape to facilitate the cleaning action of the cleaning device as it moves back and forth across said screen being cleaned.

* * * * *